US011279985B2

(12) United States Patent
Natori et al.

(10) Patent No.: US 11,279,985 B2
(45) Date of Patent: Mar. 22, 2022

(54) NON-ORIENTED ELECTRICAL STEEL SHEET

(71) Applicant: NIPPON STEEL CORPORATION, Tokyo (JP)

(72) Inventors: Yoshiaki Natori, Tokyo (JP); Kazutoshi Takeda, Tokyo (JP); Hiroyoshi Yashiki, Tokyo (JP); Miho Tomita, Tokyo (JP); Hiroshi Fujimura, Tokyo (JP); Takeaki Wakisaka, Tokyo (JP); Tesshu Murakawa, Tokyo (JP); Takuya Matsumoto, Tokyo (JP); Hiroki Hori, Tokyo (JP); Yuuya Gohmoto, Tokyo (JP); O Uyama, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 131 days.

(21) Appl. No.: 16/606,107

(22) PCT Filed: Jul. 19, 2018

(86) PCT No.: PCT/JP2018/027078
§ 371 (c)(1),
(2) Date: Oct. 17, 2019

(87) PCT Pub. No.: WO2019/017426
PCT Pub. Date: Jan. 24, 2019

(65) Prior Publication Data

US 2020/0040423 A1 Feb. 6, 2020

(30) Foreign Application Priority Data

Jul. 19, 2017 (JP) ..... JP2017-139765

(51) Int. Cl.
*C21D 9/46* (2006.01)
*H01F 1/147* (2006.01)
(Continued)

(52) U.S. Cl.
CPC ..... *C21D 9/46* (2013.01); *C21D 6/001* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2010/0158744 A1 6/2010 Murakami
2013/0306200 A1 11/2013 Kohno et al.
(Continued)

FOREIGN PATENT DOCUMENTS

CN 1078270 A 11/1993
CN 100999050 A 7/2007
(Continued)

OTHER PUBLICATIONS

Japanese Opposition dated Oct. 3, 2019, for counterpart Japanese Application No. 2018-560686, with partial translation.
(Continued)

*Primary Examiner* — Xiaowei Su
(74) *Attorney, Agent, or Firm* — Birch, Stewart, Kolasch & Birch, LLP

(57) ABSTRACT

A non-oriented electrical steel sheet includes, as a chemical composition, by mass %: C: 0.0015% to 0.0040%; Si: 3.5% to 4.5%; Al: 0.65% or less; Mn: 0.2% to 2.0%; Sn: 0% to 0.20%; Sb: 0% to 0.20%; P: 0.005% to 0.150%; S: 0.0001% to 0.0030%; Ti: 0.0030% or less; Nb: 0.0050% or less; Zr: 0.0030% or less; Mo: 0.030% or less; V: 0.0030% or less; N:
(Continued)

0.0010% to 0.0030%; O: 0.0010% to 0.0500%; Cu: less than 0.10%; Ni: less than 0.50%; and a remainder including Fe and impurities, in which a product sheet thickness is 0.10 mm to 0.30 mm, an average grain size is 10 μm to 40 μm, an iron loss W10/800 is 50 W/Kg or less, a tensile strength is 580 MPa to 700 MPa, and a yield ratio is 0.82 or more.

6 Claims, 3 Drawing Sheets

(51) Int. Cl.

| | |
|---|---|
| ***C21D 6/00*** | (2006.01) |
| ***C21D 8/00*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *C21D 8/005* (2013.01); *C21D 8/1272* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *H01F 1/147* (2013.01)

(56) References Cited

U.S. PATENT DOCUMENTS

| | | | | |
|---|---|---|---|---|
| 2014/0041789 | A1 | 2/2014 | Kubota | |
| 2015/0013844 | A1 | 1/2015 | Xie et al. | |
| 2015/0027590 | A1 | 1/2015 | Nakanishi et al. | |
| 2015/0213928 | A1 | 6/2015 | Toda et al. | |
| 2015/0318093 | A1 | 11/2015 | Hill et al. | |
| 2017/0260600 | A1* | 9/2017 | Okubo | C21D 8/12 |
| 2017/0283903 | A1 | 10/2017 | Boettcher et al. | |
| 2018/0066333 | A1 | 3/2018 | Nakajima et al. | |
| 2018/0355454 | A1 | 12/2018 | Okubo et al. | |
| 2019/0244735 | A1 | 8/2019 | Oda et al. | |
| 2019/0330708 | A1* | 10/2019 | Okubo | H01F 1/16 |
| 2020/0087748 | A1* | 3/2020 | Lee | C21D 9/46 |

FOREIGN PATENT DOCUMENTS

| | | | |
|---|---|---|---|
| CN | 101466851 | A | 6/2009 |
| CN | 102151695 | A | 8/2011 |
| CN | 102226251 | A | 10/2011 |
| CN | 102634729 | A | 8/2012 |
| CN | 102925816 | A | 2/2013 |
| CN | 103173678 | A | 6/2013 |
| CN | 103290190 | A | 9/2013 |
| CN | 103392021 | A | 11/2013 |
| CN | 103849810 | A | 6/2014 |
| CN | 104160043 | A | 11/2014 |
| CN | 104532119 | A | 4/2015 |
| CN | 106282871 | A | 1/2017 |
| CN | 106435356 | A | 2/2017 |
| CN | 106435358 | A | 2/2017 |
| CN | 106957994 | A | 7/2017 |
| CN | 107208230 | A | 9/2017 |
| CN | 109890994 | A | 6/2019 |
| CN | 110366604 | A | 10/2019 |
| JP | 2004-300535 | A | 10/2004 |
| JP | 2004-315956 | A | 11/2004 |
| JP | 4018790 | B | 12/2007 |
| JP | 2008-50686 | A | 3/2008 |
| JP | 2010-121150 | A | 6/2010 |
| JP | 2011-6721 | A | 1/2011 |
| JP | 5228379 | B | 7/2013 |
| JP | 2014-173099 | A | 9/2014 |
| JP | 2016-138316 | A | 8/2016 |
| JP | 2017-119897 | A | 7/2017 |
| TW | 201720935 | A | 6/2017 |
| WO | WO 93/08313 | A1 | 4/1993 |
| WO | WO 2016/017263 | A1 | 2/2016 |

OTHER PUBLICATIONS

Chinese Office Action and Search Report, dated Mar. 5, 2020, for Chinese Application No. 201880028307.9, with an English translation.

"Metallic materials-Tensile testing-Method of test at room temperature", JIS Z 2241, 2011, total of 37 pages.

"Methods of measurement of the magnetic properties of magnetic steel sheet and strip by means of a single sheet tester", JIS C 2556, 1996, total of 170 pages.

"Steels-Micrographic determination of the apparent grain size", JIS G 0551, 2013, total of 90 pages.

"Test methods for electrical steel strip and sheet-Part 1: Methods of measurement of the magnetic properties of electrical steel strip and sheet by means of an Epstein frame", JIS C 2550-1, 2011, total of 477 pages.

"Test pieces for tensile test for metallic materials", JIS Z 2201, 1998, total of 6 pages.

International Search Report for PCT/JP2018/027078 (PCT/ISA/210) dated Oct. 2, 2018.

Taiwanese Office Action issued in in TW Application No. 107125000 dated Mar. 27, 2019.

Written Opinion of the International Searching Authority for PCT/JP2018/027078 (PCT/ISA/237) dated Oct. 2, 2018.

* cited by examiner

NON-ORIENTED ELECTRICAL STEEL SHEET

TECHNICAL FIELD OF THE INVENTION

The present invention relates to a non-oriented electrical steel sheet.

Priority is claimed on Japanese Patent Application No. 2017-139765, filed on Jul. 19, 2017, the content of which is incorporated herein by reference.

RELATED ART

Recently, global environmental problems have attracted attention, and the demand for energy saving efforts has further increased. In particular, an increase in efficiency of electrical devices is strongly demanded in recent years. For this reason, also in a non-oriented electrical steel sheet that has been widely used as a core material of a motor, a generator, or the like, there has been an increasing demand for the improvement in magnetic properties. The trend is significant in motors for electric vehicles and hybrid vehicles and motors for compressors.

The motor cores of various motors as mentioned above are constituted of a stator and a rotor. The properties required for the stator and the rotor that constitute the motor core are different from each other. The stator particularly requires excellent magnetic properties (iron loss and density of magnetic flux), whereas the rotor requires excellent mechanical properties (tensile strength and yield ratio).

The properties required for the stator and the rotor are different from each other. Therefore, if a non-oriented electrical steel sheet for the stator and a non-oriented electrical steel sheet for the rotor are separately prepared, the respective desired properties can be realized. However, preparing two kinds of non-oriented electrical steel sheets results in a decrease in yield. Therefore, in order to realize excellent strength required for the rotor and the low iron loss required for the stator, a non-oriented electrical steel sheet excellent in strength and also excellent in magnetic properties has been examined in the related art.

For example, in Patent Documents 1 to 3 below, techniques in which, in order to realize excellent strength required for the rotor while realizing excellent magnetic properties required for the stator, silicon (Si) is contained as a chemical composition of a steel sheet in a large amount and elements that contribute to high-strengthening, such as nickel (Ni) or copper (Cu), are intentionally added.

PRIOR ART DOCUMENT

Patent Document

[Patent Document 1] Japanese Unexamined Patent Application, First Publication No. 2004-300535

[Patent Document 2] Japanese Unexamined Patent Application, First Publication No. 2004-315956

[Patent Document 3] Japanese Unexamined Patent Application, First Publication No. 2008-50686

DISCLOSURE OF THE INVENTION

Problems to be Solved by the Invention

However, in order to realize the energy saving properties required for motors of electric vehicles and hybrid vehicles in recent years, the techniques as disclosed in Patent Documents 1 to 3 insufficiently achieve the reduction in iron loss for a stator material.

In addition, the elements that promote high-strengthening, such as Ni and Cu disclosed in Patent Documents 1 to 3 are expensive, and when these elements are positively added, the manufacturing cost of a non-oriented electrical steel sheet increases.

Furthermore, in recent years, motors for electric vehicles and hybrid vehicles have been made to earn motor torque by increasing the motor rotational speed in many designs, and further high-strengthening of the rotor is strongly required. In order to secure the safety of the motor, not only the limit properties of fracture indicated by tensile strength, but also fracture due to fatigue have to be avoided. For this, it is important to obtain high yield stress (that is, to obtain a high yield ratio) as well as simple tensile strength. However, even if the techniques disclosed in Patent Documents 1 to 3 are used, it is difficult to achieve a further increase in the high-strengthening and yield ratio of the rotor.

The present invention has been made in view of the above problems. An object of the present invention is to provide a non-oriented electrical steel sheet having high strength and high yield ratio with reduced a manufacturing cost.

Preferably, there is provided a non-oriented electrical steel sheet in which in a case where the obtained non-oriented electrical steel sheet having high strength and high yield ratio is punched into a desired motor core shape (a rotor shape and a stator shape), a plurality of the punched non-oriented electrical steel sheets are laminated to form the desired motor core shape (the rotor shape and the stator shape), and annealing is performed on the one laminated into the stator shape, superior magnetic properties are exhibited.

Means for Solving the Problem

In order to solve the above-described problems, the present inventors intensively conducted examinations. Specifically, intensive examinations were conducted regarding a method in which members for a rotor and a stator are punched from the same non-oriented electrical steel sheet, and after the members for a rotor are laminated into a desired rotor shape, superior mechanical properties are exhibited without subsequent annealing performed on the laminate, whereas, after the members for a stator are laminated into a desired stator shape, superior magnetic properties are realized by performing annealing on the laminate.

Hereinafter, annealing which is performed on a laminated object, after a non-oriented electrical steel sheet is punched into a desired stator shape to obtain members for a stator and the punched members for a stator is laminated into the desired stator shape, is referred to as "core annealing".

Among non-oriented electrical steel sheets having equivalent tensile strength, a possibility that a non-oriented electrical steel sheet is caused to have an upper yield point in order to realize a high yield ratio for the purpose of improving fatigue strength is considered.

The present inventors focused on controlling a non-oriented electrical steel sheet to have an upper yield point by utilizing strain aging of carbon (C). However, non-oriented electrical steel sheets that are generally manufactured have high purity and an amount of C that causes strain aging is low. In particular, in a non-oriented electrical steel sheet having a Si content of 3% or more, Si suppresses the formation of carbides and thus no upper yield point is provided. In addition, in a non-oriented electrical steel sheet in which elements such as C, titanium (Ti), and niobium (Nb) are intentionally included simply for the purpose of high-strengthening, even if a yielding phenomenon occurs due to the including a large amount of C, carbides significantly deteriorate grain growth during core annealing, so that the magnetic properties after the core annealing are not improved.

Therefore, in the related art, it has been difficult to obtain a non-oriented electrical steel sheet having an upper yield point and excellent magnetic properties after core annealing.

Based on this viewpoint, the present inventors conducted further examinations. As a result, it was found that in a non-oriented electrical steel sheet having a high Si content with no intentional inclusion of expensive elements, superior mechanical properties are obtained by further refining the grain size and thus realizing a yielding phenomenon. Furthermore, the knowledge that when the inclusion of elements that inhibit grain growth during core annealing to the non-oriented electrical steel sheet can be suppressed, superior magnetic properties can be simultaneously improved after the core annealing was obtained.

The gist of the present invention completed based on the above knowledge is as follows.

[1] According to an aspect of the present invention, a non-oriented electrical steel sheet includes, as a chemical composition, by mass %: C: 0.0015% to 0.0040%; Si: 3.5% to 4.5%; Al: 0.65% or less; Mn: 0.2% to 2.0%; Sn: 0% to 0.20%; Sb: 0% to 0.20%; P: 0.005% to 0.150%; S: 0.0001% to 0.0030%; Ti: 0.0030% or less; Nb: 0.0050% or less; Zr: 0.0030% or less; Mo: 0.030% or less; V: 0.0030% or less; N: 0.0010% to 0.0030%; O: 0.0010% to 0.0500%; Cu: less than 0.10%; Ni: less than 0.50%; and a remainder including Fe and impurities, in which a product sheet thickness is 0.10 mm to 0.30 mm, an average grain size is 10 μm to 40 μm iron loss W10/800 is 50 W/Kg or less, a tensile strength is 580 MPa to 700 MPa, and a yield ratio is 0.82 or more.

[2] In the non-oriented electrical steel sheet according to [1], amounts of C, Ti, Nb, Zr, and V may satisfy conditions expressed by Formula (1), $$[C]\times([Ti]+[Nb]+[Zr]+[V])<0.000010 \quad (1)$$

where a notation [X] in the Formula (1) represents an amount of an element X (unit: mass %).

[3] In the non-oriented electrical steel sheet according to [1] or [2], the average grain size may be 60 μm to 150 μm and the iron loss W10/400 may be 11 W/Kg or less, when annealing is performed under annealing conditions within a range in which an annealing temperature is 750° C. or more and 900° C. or less and a soaking time is 10 minutes to 180 minutes.

[4] In the non-oriented electrical steel sheet according to any one of [1] to [3], the non-oriented electrical steel sheet may have an upper yield point and a lower yield point, and the upper yield point may be higher than the lower yield point by 5 MPa or more.

[5] The non-oriented electrical steel sheet according to any one of [1] to [4] may include, as the chemical composition, by mass %: any one or both of Sn: 0.01% to 0.20%, and Sb: 0.01% to 0.20%.

[6] The non-oriented electrical steel sheet according to any one of [1] to [5] may further include: an insulating coating on a surface of the non-oriented electrical steel sheet.

Effects of the Invention

According to the aspect of the present invention, it is possible to obtain a non-oriented electrical steel sheet in which the manufacturing cost is suppressed and the mechanical properties and the magnetic properties after core annealing are superior.

EMBODIMENTS OF THE INVENTION

Figure 1:
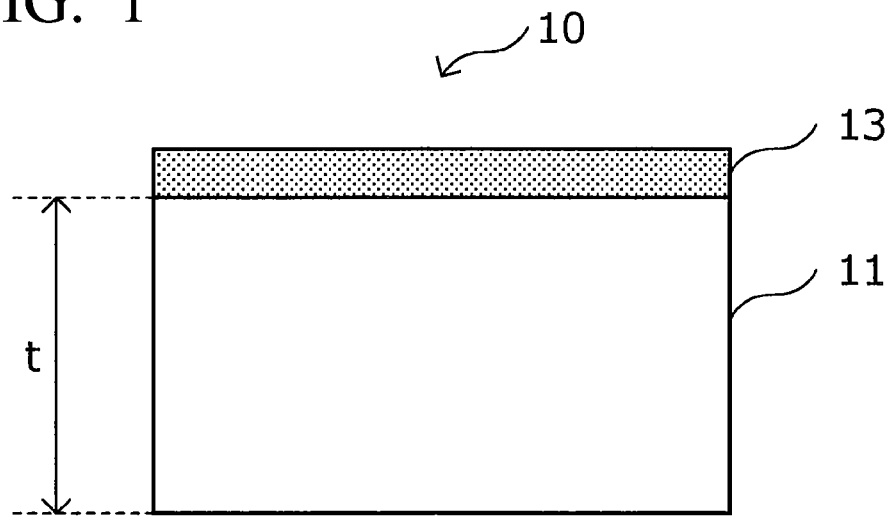
FIG. 1 is an explanatory view schematically showing a structure of a non-oriented electrical steel sheet according to an embodiment of the present invention.

Preferred embodiments of the present invention will be described in detail with reference to the accompanying drawings. In the present specification and the drawings, like components having substantially the same functional configurations are denoted by like reference numerals, and overlapping descriptions will be omitted.

(Non-Oriented Electrical Steel Sheet)

First, a non-oriented electrical steel sheet according to an embodiment of the present invention (a non-oriented electrical steel sheet according to the present embodiment) will be described in detail with reference to FIGS. 1 to 5.

Figure 2:
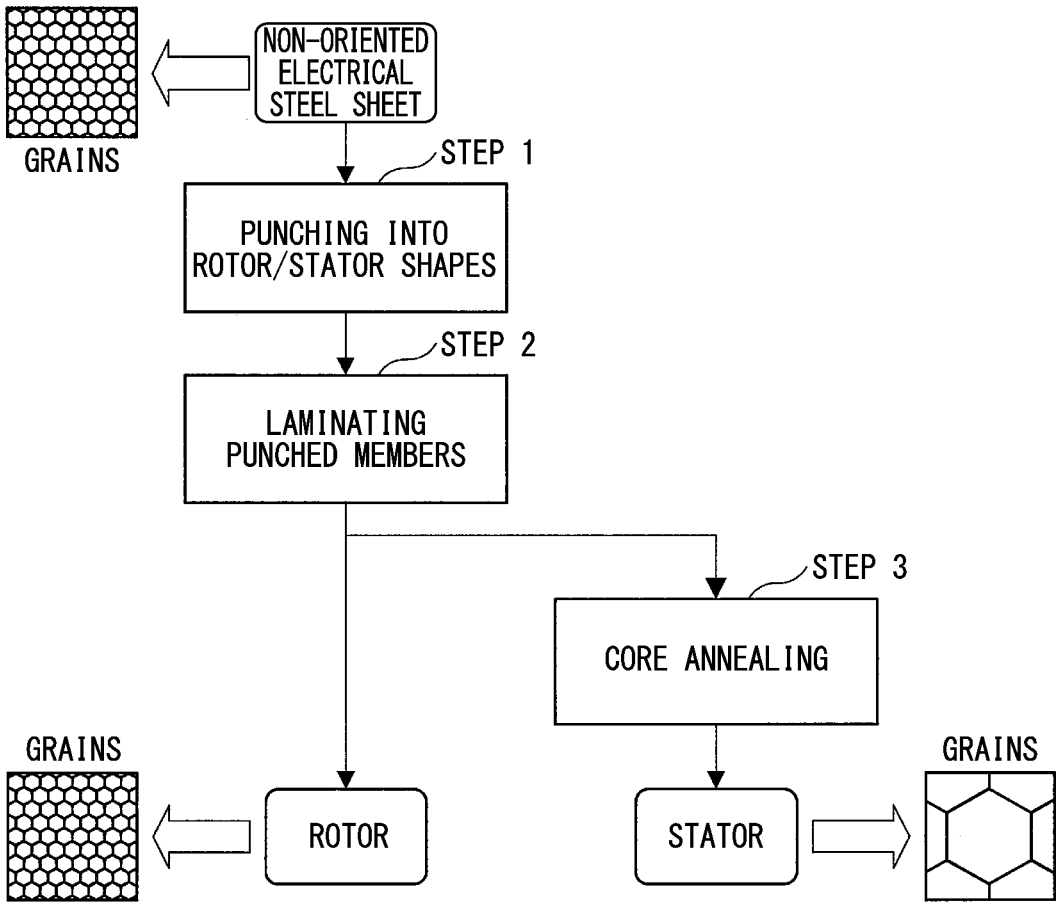
FIG. 2 is an explanatory view for describing the non-oriented electrical steel sheet according to the embodiment.
Figure 3:
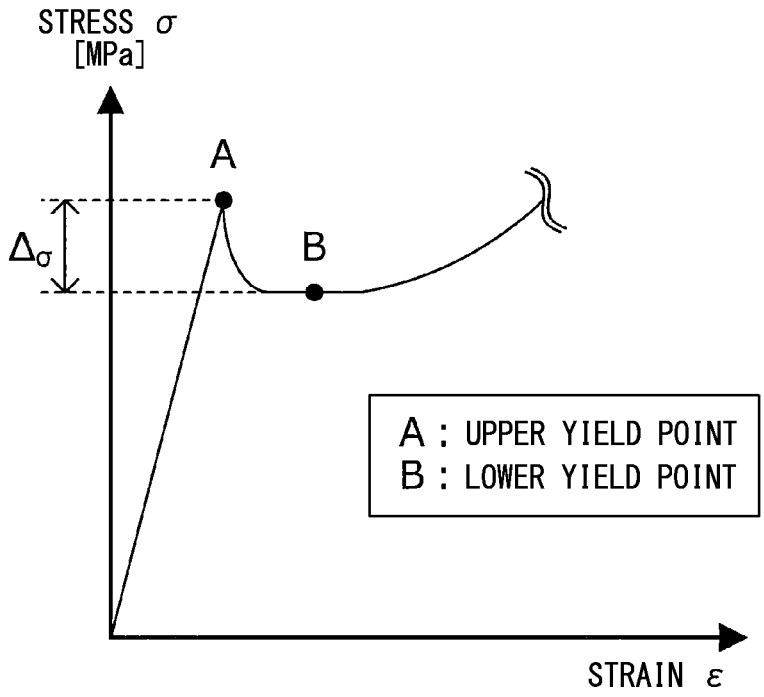
FIG. 3 is an explanatory view for explaining a stress-strain curve shown by the non-oriented electrical steel sheet according to the embodiment.
Figure 4:
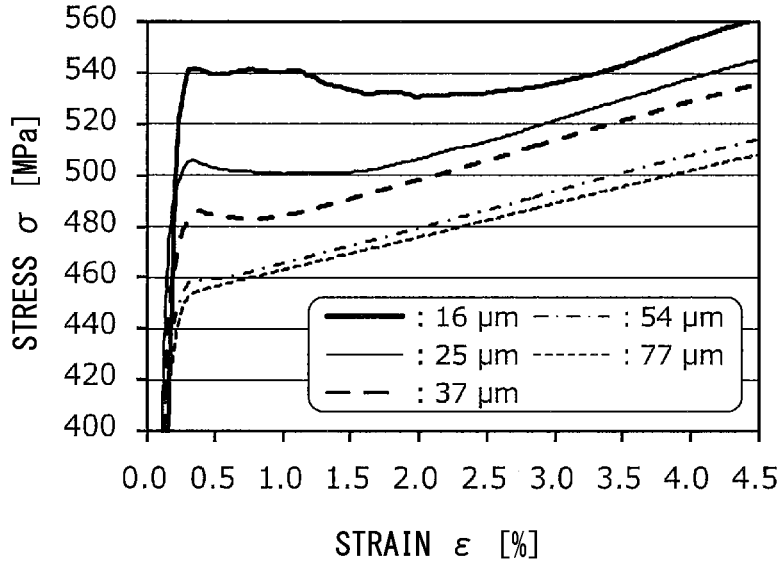
FIG. 4 is a view showing an example of a stress-strain curve shown by the non-oriented electrical steel sheet.
Figure 5:
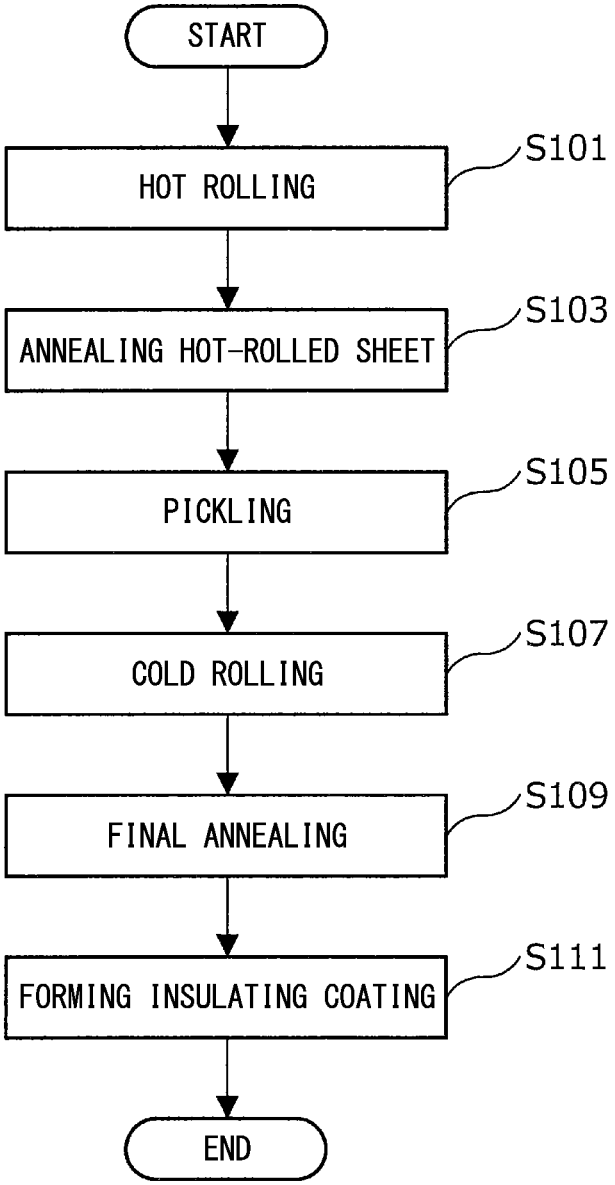
FIG. 5 is a flowchart showing an example of the flow of a method of manufacturing the non-oriented electrical steel sheet according to the embodiment.

FIG. 1 is an explanatory view schematically showing the structure of the non-oriented electrical steel sheet according to the present embodiment. FIG. 2 is an explanatory view for describing the non-oriented electrical steel sheet according to the present embodiment. FIG. 3 is an explanatory view for describing a stress-strain curve shown by the non-oriented electrical steel sheet according to the present embodiment. FIG. 4 is a view showing an example of a stress-strain curve shown by the non-oriented electrical steel sheet. FIG. 5 is a flowchart showing an example of the flow of a method of manufacturing the non-oriented electrical steel sheet according to the present embodiment.

A non-oriented electrical steel sheet 10 according to the present embodiment is a non-oriented electrical steel sheet 10 suitable as a material when both a stator and a rotor are manufactured. As schematically shown in FIG. 1, the non-oriented electrical steel sheet 10 according to the present embodiment has a base metal 11 that contains a predetermined chemical composition and exhibits predetermined mechanical properties and magnetic properties. In addition, it is preferable that the non-oriented electrical steel sheet 10 according to the present embodiment further has an insulating coating 13 on the surface of the base metal 11.

Hereinafter, first, the base metal 11 of the non-oriented electrical steel sheet 10 according to the present embodiment will be described in detail.

<Chemical Composition of Base Metal>

The base metal 11 of the non-oriented electrical steel sheet 10 according to the present embodiment contains, by mass %, C: 0.0015% to 0.0040%, Si: 3.5% to 4.5%, Al: 0.65% or less, Mn: 0.2% to 2.0%, P: 0.005% to 0.150%, S: 0.0001% to 0.0030%, Ti: 0.0030% or less, Nb: 0.0050% or less, Zr: 0.0030% or less, Mo: 0.030% or less, V: 0.0030% or less, N: 0.0010% to 0.0030%, O: 0.0010% to 0.0500%, Cu: less than 0.10%, and Ni: less than 0.50%, if necessary, further contains one or both of Sn and Sb each in an amount of 0.01 mass % or more and 0.2 mass % or less, and a remainder consisting of Fe and impurities.

The base metal 11 is, for example, a steel sheet such as a hot-rolled steel sheet or a cold-rolled steel sheet.

Hereinafter, the reason why the chemical composition of the base metal 11 according to the present embodiment is specified as described above will be described in detail. Hereinafter, "%" represents "mass %" unless otherwise specified.

[C: 0.0015% to 0.0040%]

C (carbon) is an element that causes deterioration in iron loss. In a case where the C content exceeds 0.0040%, deterioration in iron loss occurs in the non-oriented electrical steel sheet, and good magnetic properties cannot be obtained. Therefore, in the non-oriented electrical steel sheet 10 according to the present embodiment, the C content is set to 0.0040% or less. The C content is preferably 0.0035% or less, and more preferably 0.0030% or less.

On the other hand, in a case where the C content is less than 0.0015%, an upper yield point does not occur in the non-oriented electrical steel sheet 10, and a good yield ratio cannot be obtained. Therefore, in the non-oriented electrical steel sheet 10 according to the present embodiment, the C content is set to 0.0015% or more. In the non-oriented electrical steel sheet according to the present embodiment, the C content is preferably 0.0020% or more, and more preferably 0.0025% or more.

[Si: 3.5% to 4.5%]

Si (silicon) is an element that reduces eddy-current loss by increasing the electrical resistance of steel and thus improves high-frequency iron loss. In addition, Si is an element effective also in high-strengthening of the non-oriented electrical steel sheet 10 because its capability of solid solution strengthening is high. In order to exhibit the above effects sufficiently, it is necessary to contain 3.5% or more of Si. The Si content is preferably 3.6% or more.

On the other hand, in a case where the Si content exceeds 4.5%, the workability is significantly deteriorated and it becomes difficult to perform cold rolling. Therefore, the Si content is set to 4.5% or less. The Si content is preferably 4.0% or less, and more preferably 3.9% or less.

[Al: 0.65% or Less]

Al (aluminum) is an element effective for reducing the eddy-current loss by increasing the electrical resistance of the non-oriented electrical steel sheet and thus improving the high-frequency iron loss. On the other hand, Al also has an effect of reducing the workability in a steel sheet manufacturing process and the density of magnetic flux of a product. Therefore, the Al content is set to 0.65% or less.

Moreover, in order to obtain good magnetic properties after core annealing, it is important to suppress the adverse effect of solid solution Ti. However, in a case where the Al content is high, AlN instead of TiN is precipitated as nitride, resulting in an increase in solid solution Ti. In a case where the Al content exceeds 0.50%, the density of magnetic flux of the non-oriented electrical steel sheet is significantly decreased, and the non-oriented electrical steel sheet becomes embrittled. Therefore, it becomes difficult to perform cold rolling thereon, so that the magnetic properties after core annealing become inferior. Therefore, in consideration of the magnetic properties after core annealing, the Al content is preferably set to 0.50% or less. The Al content is more preferably 0.40% or less, and even more preferably 0.35% or less.

On the other hand, the lower limit value of the Al content is not particularly limited and may be 0%. However, when the Al content is set to be less than 0.0005%, the load in steel making is high and the cost is increased. Therefore, the Al content is preferably set to 0.0005% or more. In addition, in a case of obtaining the effect of improving high-frequency iron loss, the Al content is preferably 0.10% or more, and more preferably 0.20% or more.

[Mn: 0.2% to 2.0%]

Mn (manganese) is an element effective for reducing the eddy-current loss by increasing the electrical resistance of steel and thus improving the high-frequency iron loss. In order to exhibit the above effect sufficiently, it is necessary to contain 0.2% or more of Mn. In addition, in a case where the Mn content is less than 0.2%, fine sulfides (MnS) precipitate and grain growth during core annealing is deteriorated, which is not preferable. The Mn content is preferably 0.4% or more, and more preferably 0.5% or more.

On the other hand, in a case where the Mn content exceeds 2.0%, the decrease in density of magnetic flux becomes significant. Therefore, the Mn content is set to 2.0% or less. The Mn content is preferably 1.7% or less, and more preferably 1.5% or less.

[P: 0.005% to 0.150%]

P (phosphorus) is an element that has a high capability of solid solution strengthening and also has an effect of increasing a {100} texture which is advantageous for improving the magnetic properties, and is an element extremely effective in achieving both high strength and high density of magnetic flux. Furthermore, since the increase in the {100} texture also contributes to a reduction in the anisotropy of the mechanical properties in the sheet surface of the non-oriented electrical steel sheet 10, P also has an effect of improving the dimensional accuracy during punching of the non-oriented electrical steel sheet 10. In order to obtain the effect of improving such strength, magnetic properties, and dimensional accuracy, the P content needs to be 0.005% or more. The P content is preferably 0.010% or more, and more preferably 0.020% or more.

On the other hand, in a case where the P content exceeds 0.150%, the ductility of the non-oriented electrical steel sheet 10 is significantly decreased. Therefore, the P content is set to 0.150% or less. The P content is preferably 0.100% or less, and more preferably 0.080% or less.

[S: 0.0001% to 0.0030%]

S (sulfur) is an element that increases the iron loss by forming fine precipitates of MnS and thus degrades the magnetic properties of the non-oriented electrical steel sheet 10. Therefore, the S content needs to be 0.0030% or less. The S content is preferably 0.0020% or less, and more preferably 0.0010% or less.

On the other hand, if it is attempted to reduce the S content to be less than 0.0001%, the cost is unnecessarily increased. Therefore, the S content is set to 0.0001% or more. The S content is preferably 0.0003% or more, and more preferably 0.0005% or more.

[Ti: 0.0030% or Less]

Ti (titanium) is an element that can be unavoidably incorporated in steel, and is an element that is bonded to carbon and nitrogen to form inclusions (carbides and nitrides). In a case where carbides are formed, the growth of grains during core annealing is inhibited and the magnetic properties are deteriorated. Therefore, the Ti content is set to 0.0030% or less. The Ti content is preferably 0.0015% or less, and more preferably 0.0010% or less.

On the other hand, the Ti content may be 0%. However, if it is attempted to reduce the Ti content to less than 0.0005%, the cost is unnecessarily increased. Therefore, the Ti content is preferably set to 0.0005% or more.

[Nb: 0.0050% or Less]

Nb (niobium) is an element that is bonded to carbon and nitrogen to form inclusions (carbides and nitrides) and thus contributes to high-strengthening. However, Nb is an expensive element, and the Nb content is set to 0.0050% or less. In addition, Nb is also an element that inhibits the growth of grains during core annealing and causes deterioration in the magnetic properties. Therefore, in consideration of the magnetic properties after core annealing, the Nb content is preferably set to 0.0030% or less. The Nb content is preferably 0.0010% or less, and more preferably below the measurement limit (tr.) (including 0%).

[Zr: 0.0030% or Less]

Zr (zirconium) is an element that is bonded to carbon and nitrogen to form inclusions (carbides and nitrides) and thus contributes to high-strengthening. However, Zr is also an element that inhibits the growth of grains during core annealing and causes deterioration in the magnetic properties. Therefore, the Zr content is set to 0.0030% or less. The Zr content is preferably 0.0010% or less, and more preferably below the measurement limit (tr.) (including 0%).

[Mo: 0.030% or Less]

Mo (molybdenum) is an element that can be unavoidably incorporated, and is an element that is bonded to carbon to form inclusions (carbides). However, since Mo is easily solutionized at a temperature of 750° C. or more at which core annealing is performed, so that incorporation of a slight amount of Mo is allowed. On the other hand, when the amount of Mo incorporated is excessively increased, the growth of grains is inhibited and the magnetic properties are deteriorated, so that the Mo content is set to 0.030% or less. The Mo content is preferably 0.020% or less, and more preferably 0.015% or less, and may be below the measurement limit (tr.) (including 0%).

On the other hand, if it is attempted to reduce the Mo content to less than 0.0005%, the cost is unnecessarily increased. Therefore, from the viewpoint of the manufacturing cost, the Mo content is preferably set to 0.0005% or more. The Mo content is preferably 0.0010% or more.

[V: 0.0030% or Less]

V (vanadium) is an element that is bonded to carbon and nitrogen to form inclusions (carbides and nitrides) and thus contributes to high-strengthening. However, V is also an element that inhibits the growth of grains during core annealing and causes deterioration in the magnetic properties. Therefore, the V content is set to 0.0030% or less. The V content is preferably 0.0010% or less, and more preferably below the measurement limit (tr.) (including 0%).

[N: 0.0010% to 0.0030%]

N (nitrogen) is an element that is unavoidably incorporated, and is an element that increases the iron loss by causing magnetic aging and causes deterioration in the magnetic properties of the non-oriented electrical steel sheet 10. Therefore, the N content needs to be 0.0030% or less. The N content is preferably 0.0025% or less, and more preferably 0.0020% or less.

On the other hand, if it is attempted to reduce N content to less than 0.0010%, the cost is unnecessarily increased. Therefore, the N content is set to 0.0010% or more.

[O: 0.0010% to 0.0500%]

O (oxygen) is an element that is unavoidably mixed, and is an element that increases the iron loss by forming an oxide and causes deterioration in the magnetic properties of the non-oriented electrical steel sheet 10. Therefore, the O content needs to be 0.0500% or less. Since O may be incorporated in an annealing step, in a state of slab (that is, ladle value), the O content is preferably set to 0.0050% or less.

On the other hand, if it is attempted to reduce the O content to less than 0.0010%, the cost is unnecessarily increased. Therefore, the O content is set to 0.0010% or more.

[Cu: Less Than 0.10%]

[Ni: Less than 0.50%]

Cu (copper) and Ni (nickel) are elements that can be unavoidably incorporated. The intentional addition of Cu and Ni increases the manufacturing cost of the non-oriented electrical steel sheet 10. Therefore, there is no need to add Cu and Ni to the non-oriented electrical steel sheet 10 according to the present embodiment.

The Cu content is set to be less than 0.10%, which is the maximum value that can be unavoidably incorporated in the manufacturing process.

On the other hand, in particular, Ni is also an element that improves the strength of the non-oriented electrical steel sheet 10, and may be contained by intentionally adding. However, since Ni is expensive, even in a case where Ni is intentionally included, the upper limit of the Ni content is set to be less than 0.50%.

The lower limit of the Cu content and the Ni content is not particularly limited and may be 0%. However, if it is attempted to reduce the Cu content and the Ni content to less than 0.005%, the cost is unnecessarily increased. Therefore, the Cu content and the Ni content are each preferably set to 0.005% or more. Each of the Cu content and the Ni content preferably 0.01% or more and 0.09% or less, and more preferably 0.02% or more and 0.06% or less.

[Sn: 0% to 0.20%]

[Sb: 0% to 0.20%]

Sn (tin) and Sb (antimony) are optional additional elements that suppress oxidation during annealing by segregating on the surface of the steel sheet and are thus useful for securing low iron loss. Therefore, in the non-oriented electrical steel sheet according to the present embodiment, at least one of Sn and Sb may be contained in the base metal as the optional additional element in order to obtain the above-described effect. In order to sufficiently exhibit the effect, each of the Sn content and Sb content is preferably set to 0.01% or more. The Sn content and Sb content are more preferably 0.03% or more.

On the other hand, in a case where each of the Sn content and the Sb content exceeds 0.20%, there is a possibility that the ductility of the base metal may be reduced and it may be difficult to perform cold rolling. Therefore, each of the Sn content and the Sb content is preferably set to 0.20% or less even in a case where Sn or Sb is included. In a case where Sn or Sb is included in the base metal, the Sn content or Sb content is more preferably 0.10% or less.

$$[[C]\times([Ti]+[Nb]+[Zr]+[V])<0.000010]$$

The base metal 11 of the non-oriented electrical steel sheet 10 according to the present embodiment has the chemical composition as described above, but it is preferable that the amounts of C, Ti, Nb, Zr, and V of the base metal 11 further satisfy the condition expressed by the following Formula (1).

$$[C]\times([Ti]+[Nb]+[Zr]+[V])<0.000010 \quad (1)$$

Here, in the Formula (1), the notation [X] represents the amount (unit: mass %) of the element X, that is, for example, [C] represents the C content in terms of mass %.

When C is present in the base metal 11, carbides corresponding to the C content can be formed in the base metal 11. In addition, as described above, Ti, Nb, Zr, and V are elements that form carbides with carbon, and the presence of these elements in the base metal 11 facilitates the formation of carbides. Therefore, the left side of Formula (1) can be regarded as an index representing a carbide formation ability in the base metal 11 of non-oriented electrical steel sheet 10 according to the present embodiment.

The present inventors intensively conducted examinations on the formation of carbides in the base metal 11 while changing the amounts of the chemical composition in the base metal 11. As a result, it became clear that in a case where the value given on the left side of Formula (1) becomes 0.000010 or more, carbides are formed, the growth of grains during core annealing is inhibited, and the magnetic properties after the core annealing are easily deteriorated. Therefore, in the non-oriented electrical steel sheet 10 according to the present embodiment, it is preferable that the amounts of C, Ti, Nb, Zr, and V are set so that the value given on the left side of Formula (1) is less than 0.000010. The value given on the left side of Formula (1) is more preferably 0.000006 or less, and even more preferably 0.000004 or less.

The smaller the value given on the left side of Formula (1), the more preferable, and the lower limit thereof is not particularly limited. However, based on the lower limit of the above elements in the base metal 11 according to the present embodiment, the value of 0.00000075 is a practical lower limit.

Hereinabove, the chemical composition of the base metal in the non-oriented electrical steel sheet according to the present embodiment has been described in detail.

Even if elements such as Pb, Bi, As, B, Se, Mg, Ca, La, and Ce in addition to the above-mentioned elements are contained as impurities in a range of 0.0001% to 0.0050%, the effects of the non-oriented electrical steel sheet according to the present embodiment are not impaired.

In a case of measuring the chemical composition of the base metal 11 in the non-oriented electrical steel sheet 10, it is possible to use various known measuring methods, and for example, inductively coupled plasma mass spectrometry (ICP-MS) or the like may be appropriately used.

<Average Grain Size of Base Metal>

In the non-oriented electrical steel sheet 10 according to the present embodiment, the average grain size of the base metal 11 is in a refined state of being 10 μm to 40 μm at a time after final annealing (a state where core annealing is not performed), which will be described below in detail. Since the average grain size of the base metal 11 is refined to be in a range of 10 μm to 40 μm, the proportion of grain boundaries in the base metal 11 can be increased, and a strain aging phenomenon can be incurred.

Such a refined average grain size is realized by performing cooling at a specific cooling rate after performing annealing at a specific annealing temperature for a specific soaking time under a specific atmosphere in a final annealing step, which will be described below in detail. The average grain size of the base metal 11 can be controlled by changing heat treatment conditions at the time of the final annealing.

In a case where the average grain size of the base metal 11 after the final annealing (the state where core annealing is not performed) is less than 10 μm, even if the Si content is set to the maximum value and core annealing is performed, the iron loss, which is one of the important magnetic properties required for the non-oriented electrical steel sheet, is increased, which is not preferable.

On the other hand, in a case where the average grain size of the base metal 11 after the final annealing (the state where core annealing is not performed) exceeds 40 μm, the average grain size becomes too large, and as a result, excellent strength and yield ratio required for the rotor cannot be obtained, which is not preferable. The average grain size of the base metal 11 is preferably in a range of 15 μm to 30 μm, and more preferably in a range of 20 μm to 25 μm.

Moreover, in the non-oriented electrical steel sheet 10 according to the present embodiment, when core annealing performed when a stator is manufactured is performed, grains of the base metal 11 grow and the average grain size becomes coarse. This is because the amounts of C, Ti, Nb, Zr, and V, which are elements that inhibit the growth of grains, are controlled to be in the above range. The coarsened average grain size of the base metal 11 after core annealing is preferably 60 μm to 150 μm by performing core annealing under predetermined conditions. In the present embodiment, "core annealing" is annealing performed for the purpose of promoting grain growth of grains of the base metal 11.

The predetermined conditions of the core annealing are conditions appropriately selected from an annealing temperature range of 750° C. to 900° C. and a soaking time range of 10 minutes to 180 minutes depending on the sheet thickness of electrical steel sheet, the grain size before the core annealing, and the like. A preferable annealing temperature is 775° C. to 850° C., and a preferable soaking time is 30 minutes to 150 minutes. The dew point in the annealing atmosphere may be appropriately set according to the kind and performance of an annealing furnace, but may be set, for example, in a range of −40° C. to 20° C. More specifically, for example, the core annealing may be performed in a nitrogen atmosphere with a dew point of −40° C. at an annealing temperature of 800° C. for a soaking time of 120 minutes.

In a case where the average grain size of the base metal 11 after being subjected to the predetermined core annealing is less than 60 μm, even if the Si content is set to the maximum value, the iron loss, which is one of the important magnetic properties required for the non-oriented electrical steel sheet, is increased, which is not preferable. In addition, even in a case where the average grain size of the base metal 11 after being subjected to the predetermined core annealing exceeds 150 μm, the grains grow too much, resulting in an increase in the iron loss, which is not preferable. The average grain size of the base metal 11 after being subjected to the predetermined core annealing is more preferably in a range of 65 μm to 120 μm, and even more preferably in a range of 70 μm to 100 μm.

As described above, in the non-oriented electrical steel sheet 10 according to the present embodiment, the average grain size of the base metal 11 largely changes when the core annealing under the predetermined condition is performed. By utilizing such features, in the non-oriented electrical steel sheet 10 according to the present embodiment, both the rotor and the stator can be manufactured from a single non-oriented electrical steel sheet, and as a result, a reduction in the yield can be suppressed.

FIG. 2 is a flowchart showing an example of a flow in a case of manufacturing a rotor and a stator using the non-oriented electrical steel sheet 10 according to the present embodiment.

As described above, in the non-oriented electrical steel sheet 10 according to the present embodiment, in the state where the core annealing is not performed, the average grain size of the base metal 11 is in a range of 10 μm to 40 μm, and grains are in the refined state. By punching the non-oriented electrical steel sheet 10 into the shapes of a rotor and a stator (step 1), members for manufacturing a rotor and a stator are manufactured. Subsequently, the manufactured members for manufacturing a rotor and the members for manufacturing a stator are each laminated (step 2). Even after the punching step and the laminating step, the average grain size of the base metal 11 in each of the laminated members is in a range of 10 μm to 40 μm.

As shown in FIG. 2, a rotor is manufactured using the laminated members for manufacturing a rotor (without undergoing core annealing). The manufactured rotor is in a state where the average grain size of the base metal 11 is refined to be 10 μm to 40 μm, and thus has excellent strength (for example, a strength as high as a tensile strength of 580 MPa or more) and a high yield ratio (0.82 or more) required for the rotor.

In addition, as shown in FIG. 2, the core annealing is performed on the laminated members for manufacturing a stator (step 3), whereby a stator is manufactured. In the non-oriented electrical steel sheet 10 according to the present embodiment, the grains of the base metal 11 grow largely by the core annealing, and enter a range of 60 μm to 150 μm as described above, for example, when core annealing under predetermined conditions is performed, so that excellent iron loss and density of magnetic flux can be realized.

The average grain size of the base metal 11 as described above can be obtained by applying, for example, the cutting method of JIS G 0551 "Steels-Micrographic determination of the apparent grain size" to a structure of a Z cross section at the center in a sheet thickness direction.

<Mechanical Properties>

In the non-oriented electrical steel sheet 10 according to the present embodiment having the above-described chemical composition, and the average grain size of the base metal 11 after being subjected to the final annealing (the state where core annealing is not performed) is refined to be 10 μm to 40 μm. As a result, the tensile strength becomes 580 MPa to 700 MPa.

Moreover, when the non-oriented electrical steel sheet 10 according to the present embodiment is manufactured, after annealing is performed under a specific atmosphere at a specific annealing temperature for a specific soaking time, cooling is performed at a specific cooling rate. As a result, a yielding phenomenon occurs and an upper yield point and a lower yield point are shown.

In the present embodiment, the upper yield point is defined as a point at which the stress shows the maximum value in a small strain region before the tensile strength (the left side from the position indicating the tensile strength), like point A in FIG. 3. The lower yield point is a point at which the stress value decreases after passing the upper yield point. In the non-oriented electrical steel sheet, it is difficult to achieve a constant value as found in other steel kinds. Therefore, in the present embodiment, as indicated by point B in FIG. 3, the lower yield point is defined as a point at which the stress shows the minimum value between the upper yield point and the point showing tensile strength.

In the non-oriented electrical steel sheet 10 according to the present embodiment, the yield ratio is 0.82 or more. By causing the yield ratio to be 0.82 or more, the non-oriented electrical steel sheet 10 according to the present embodiment exhibits superior mechanical properties as a rotor. The yield ratio is preferably 0.84 or more. The upper limit value of the yield ratio is not particularly limited, and the larger the yield ratio, the better. However, the upper limit thereof is actually about 0.90.

Moreover, in the non-oriented electrical steel sheet 10 according to the present embodiment, the difference ($\Delta_o$ in FIG. 3) between the stress value at the upper yield point (point A in FIG. 3) and the stress value at the lower yield point (point B in FIG. 3) is preferably 5 MPa or more. When $\Delta_o$ is 5 MPa or more, a yield ratio of 0.82 or more can be easily obtained.

FIG. 4 shows an example of measurement results of stress-strain curves in a case where the steel having the above-described chemical composition is fixed under an annealing atmosphere, which will be described below in detail, for a soaking time of 20 seconds and the annealing temperature is then changed to five kinds.

In a case where the annealing temperature is set to 950° C. and 1000° C., which are final annealing temperatures of a general non-oriented electrical steel sheet, the average grain size of the base metal 11 becomes 54 μm in the case of 950° C. and becomes 77 μm in the case of 1000° C. On the other hand, in a case where the annealing temperature is set to 800° C., 850° C., or 900° C., which is in a final annealing temperature range according to the present embodiment as described below in detail, the average grain size of the base metal 11 becomes 16 μm in the case of 800° C., becomes 25 μm in the case of 850° C., and becomes 37 μm in the case of 900° C.

The measurement results of the stress-strain curves of the obtained five kinds of non-oriented electrical steel sheets 10 are as shown in FIG. 4.

As shown in FIG. 4, in the stress-strain curves of the non-oriented electrical steel sheets according to the present embodiment in which the average grain size is 16 μm, 25 μm, and 37 μm, a yielding phenomenon in which an upper yield point and a lower yield point are observed is exhibited. On the other hand, the stress-strain curves of the non-oriented electrical steel sheets in which the average grain size is 54 μm and 77 μm, no upper yield point and no lower yield point are present.

The tensile strength and the yield point as described above can be measured by producing a test piece defined in JIS Z 2201 and then conducting a tensile test thereon using a tensile tester.

<Sheet Thickness of Base Metal>

The sheet thickness of the base metal 11 (thickness tin FIG. 1, which can be regarded as a product sheet thickness of the non-oriented electrical steel sheet 10) in the non-oriented electrical steel sheet 10 according to the present embodiment needs to be 0.30 mm or less in order to reduce the high-frequency iron loss. On the other hand, in a case where the sheet thickness t of the base metal 11 is less than 0.10 mm, there is a possibility that it may become difficult to pass the sheet through an annealing line due to the small sheet thickness. Therefore, the sheet thickness t of the base metal 11 in the non-oriented electrical steel sheet 10 is set to 0.10 mm or more and 0.30 mm or less. The sheet thickness t of the base metal 11 in the non-oriented electrical steel sheet 10 is preferably 0.15 mm or more and 0.25 mm or less.

<Magnetic Properties after Finish Annealing and Before Core Annealing>

In the non-oriented electrical steel sheet 10 according to the present embodiment, the iron loss W10/800 after final annealing (the state where core annealing is not performed) is 50 W/kg or less. The iron loss W10/800 is preferably 48 W/kg or less, and more preferably 45 W/kg or less.

<Magnetic Properties after Core Annealing>

In the non-oriented electrical steel sheet 10 according to the present embodiment, the grains of the base metal 11 grow by performing the predetermined core annealing as described above, and a superior iron loss is exhibited. In the non-oriented electrical steel sheet 10 according to the present embodiment, the iron loss W10/400 is preferably 11 W/Kg or less. The iron loss W10/400 is more preferably 10 W/Kg or less. Here, the conditions of the core annealing can be, for example, an annealing temperature of 800° C. and a soaking time of 120 minutes in a nitrogen atmosphere with a dew point of −40° C.

Various magnetic properties of the non-oriented electrical steel sheet 10 according to the present embodiment can be measured based on the Epstein method defined in JIS C 2550 and Methods of measurement of the magnetic properties of electrical steel strip and sheet by means of a single sheet tester (SST) defined in JIS C 2556.

<Insulating Coating>

Returning to FIG. 1, the insulating coating 13 which is preferably included in the non-oriented electrical steel sheet 10 according to the present embodiment will be briefly described.

Non-oriented electrical steel sheets are subjected to core blank punching and are laminated so as to be used. Therefore, by providing the insulating coating 13 on the surface of the base metal 11, the eddy current between the sheets can be reduced, and the eddy-current loss as a core can be reduced.

The insulating coating 13 of the non-oriented electrical steel sheet 10 according to the present embodiment is not particularly limited as long as it is used as an insulating coating of a non-oriented electrical steel sheet, and a known insulating coating can be used. Examples of such an insulating coating include a composite insulating coating which primarily contains an inorganic and further contains an organic. Here, the composite insulating coating is, for example, an insulating coating which primarily contains at least one of inorganic such as metal chromate, metal phosphate, colloidal silica, a Zr compound, and a Ti compound, and contains fine organic resin particles dispersed therein. In particular, from the viewpoint of a reduction in the environmental load during manufacturing, for which needs increase in recent years, an insulating coating using metal phosphate, a coupling agent of Zr or Ti, or a carbonate thereof or an ammonium salt as a starting material is preferably used.

The adhesion amount of the insulating coating 13 as described above is not particularly limited, but is, for example, preferably about 400 $mg/m^2$ or more and 1200 $mg/m^2$ or less per side, and more preferably 800 $mg/m^2$ or more and 1000 $mg/m^2$ or less. By forming the insulating coating 13 so as to achieve the above-mentioned adhesion amount, excellent uniformity can be maintained. In a case of measuring the adhesion amount of the insulating coating 13, various known measuring methods can be used, and for example, a method of measuring the difference in mass before and after immersion in an aqueous solution of sodium hydroxide, an X-ray fluorescence method using a calibration curve method, and the like may be appropriately used.

(Method of Manufacturing Non-Oriented Electrical Steel Sheet)

Subsequently, a method of manufacturing the non-oriented electrical steel sheet 10 according to the present embodiment as described above will be described in detail with reference to FIG. 5. FIG. 5 is a flowchart showing an example of the flow of the method of manufacturing the non-oriented electrical steel sheet according to the present embodiment.

In the method of manufacturing the non-oriented electrical steel sheet 10 according to the present embodiment, hot rolling, annealing hot-rolled sheet, pickling, cold rolling, and final annealing are sequentially performed on a steel ingot having the predetermined chemical composition as described above. In a case where the insulating coating 13 is formed on the surface of the base metal 11, the insulating coating is formed after the above-mentioned final annealing. Hereinafter, each step performed in the method of manufacturing the non-oriented electrical steel sheet 10 according to the present embodiment will be described in detail.

<Hot Rolling Step>

In the method of manufacturing the non-oriented electrical steel sheet 10 according to the present embodiment, first, a steel ingot (slab) having the above-described chemical composition is heated, and hot rolling is performed on the heated steel ingot, whereby a hot-rolled sheet (hot-rolled steel sheet) is obtained (step S101). The heating temperature of the steel ingot at the time of being subjected to hot rolling is not particularly limited, but is, for example, preferably set to 1050° C. or more and 1200° C. or less. Furthermore, the sheet thickness of the hot-rolled sheet after hot rolling is not particularly limited, but is, for example, preferably set to about 1.5 mm to 3.0 mm in consideration of the final sheet thickness of the base metal. By subjecting the steel ingot to the above-described hot rolling, a scale primarily containing of an oxide of Fe is generated on the surface of the base metal 11.

<Step of Annealing Hot-Rolled Sheet>

After the hot rolling, annealing hot-rolled sheet is performed (step S103). In the annealing hot-rolled sheet, for example, it is preferable that the dew point in the annealing atmosphere is set to −20° C. or more and 50° C. or less, the annealing temperature is set to 850° C. or more and 1100° C. or less, and the soaking time is set to 10 seconds or more and 150 seconds or less. The soaking time refers to the time during which the temperature of the hot-rolled sheet to be subjected to annealing hot-rolled sheet is within a range of the maximum attainment temperature ±5° C.

Controlling the dew point to less than −20° C. causes an excessive increase in cost, which is not preferable. On the other hand, in a case where the dew point exceeds 50° C., oxidation of Fe in the base metal progresses, and the sheet thickness is excessively reduced by subsequent pickling, resulting in deterioration in the yield, which is not preferable. The dew point in the annealing atmosphere is preferably −10° C. or more and 40° C. or less, and more preferably −10° C. or more and 20° C. or less.

In a case where the annealing temperature is less than 850° C., or in a case where the soaking time is less than 10 seconds, the density of magnetic flux B50 is deteriorated, which is not preferable.

On the other hand, in a case where the annealing temperature exceeds 1100° C., or in a case where the soaking time exceeds 150 seconds, there is a possibility that the base metal may fracture in the subsequent cold rolling step, which is not preferable.

The annealing temperature is preferably 900° C. or more and 1050° C. or less, and more preferably 950° C. or more and 1050° C. or less. The soaking time is preferably 20 seconds or more and 100 seconds or less, and more preferably 30 seconds or more and 80 seconds or less.

Moreover, in a cooling process during the annealing hot-rolled sheet, in order to more reliably realize a yield ratio of 0.82 or more, the average cooling rate in a temperature range of 800° C. to 500° C. is preferably set to 10° C./s to 100° C./s, and more preferably set to 25° C./s or more.

In a case where the cooling rate in the temperature range of 800° C. to 500° C. is less than 10° C./s, strain aging due to solid solution C is not sufficiently obtained, and the upper yield point is less likely to occur, resulting in a reduction in the yield ratio. In order to achieve rapid cooling with an average cooling rate of 10° C./s or more, this can be achieved by increasing the amount of gas introduced from the succeeding stage, or the like.

On the other hand, from the viewpoint of mechanical properties, the average cooling rate up to a sheet temperature of 800° C. to 500° C. is preferably as high as possible. However, when the average cooling rate is too fast, the sheet shape is deteriorated and the productivity and the quality of the steel sheet are impaired. Therefore, the upper limit thereof is set to 100° C./s.

<Pickling Step>

After the annealing hot-rolled sheet, pickling is performed (step S105), such that the scale layer generated on the surface of the base metal 11 is removed. The pickling conditions such as the concentration of the acid used for pickling, the concentration of the promoter used for pickling, and the temperature of the pickling solution are not particularly limited, and may be known pickling conditions.

<Cold Rolling Step>

After the pickling, cold rolling is performed (step S107).

In the cold rolling, the pickled sheet from which the scale layer has been removed is rolled at a rolling reduction such that the final sheet thickness of the base metal is 0.10 mm or more and 0.30 mm or less. By the cold rolling, the metallographic structure of the base metal 11 becomes a cold-rolled structure obtained by cold rolling.

<Finish Annealing Step>

After the cold rolling, final annealing is performed (step S109).

In the method of manufacturing the non-oriented electrical steel sheet according to the present embodiment, the final annealing step is an important step in order to realize the average grain size of the base metal 11 as described above and to cause a yielding phenomenon to occur. In the final annealing step, the annealing atmosphere is set to a wet atmosphere with a dew point of −20° C. to 50° C., the annealing temperature is set to 750° C. or more and 900° C. or less, and the soaking time is set to 10 seconds or more and 100 seconds or less. The soaking time refers to the time during which the temperature of the cold-rolled steel sheet to be subjected to the final annealing is within a range of the maximum attainment temperature ±5° C. By performing final annealing under the above-described annealing conditions and performing cooling as described later, it is possible to realize the above-described average grain size of the base metal 11 and to cause a yielding phenomenon to occur.

In a case where the dew point of the annealing atmosphere is less than −20° C., the grain growth near the surface layer is deteriorated at the time of core annealing, resulting in inferior iron loss, which is not preferable. On the other hand, in a case where the dew point of the annealing atmosphere exceeds 50° C., internal oxidation occurs and the iron loss becomes inferior, which is not preferable. In a case where the annealing temperature is less than 750° C., the annealing time becomes too long, and the possibility of a reduction in productivity is increased, which is not preferable. On the other hand, in a case where the annealing temperature exceeds 900° C., it becomes difficult to control the grain size after final annealing, which is not preferable. In a case where the soaking time is less than 10 seconds, final annealing cannot be sufficiently performed and it may be difficult to appropriately generate a seed crystal in the base metal 11, which is not preferable. On the other hand, in a case where the soaking time exceeds 100 seconds, the possibility that the average grain size of the seed crystal generated in the base metal 11 may be out of the range mentioned above is increased, which is not preferable.

The dew point of the annealing atmosphere is preferably −10° C. or more and 20° C. or less, and more preferably 0° C. or more and 10° C. or less. The oxygen potential (a value obtained by dividing the partial pressure $P_{H2O}$ of $H_2O$ by the partial pressure $P_{H2}$ of $H_2$: $P_{H2O}/P_{H2}$) of the annealing atmosphere is preferably 0.01 to 0.30, which means a reducing atmosphere.

The annealing temperature is preferably 800° C. or more and 850° C. or less, and more preferably 800° C. or more and 825° C. or less. The soaking time is preferably 10 seconds or more and 30 seconds or less.

In order to more reliably realize an average grain size of the base metal 11 of 10 μm to 40 μm and a yield ratio of 0.82 or more as described above, the average cooling rate in a sheet temperature range of 750° C. to 600° C. is preferably 25° C./s or more, whereby rapid cooling is performed. The cooling rate in a sheet temperature range of 400° C. to 100° C. is more preferably 20° C./s or less at any timing in this interval, whereby slow cooling is performed.

In a case where the cooling rate in a sheet temperature range of 750° C. to 600° C. is less than 25° C./s, the cooling rate becomes too slow, the grains of the base metal 11 cannot be sufficiently refined, and there is a possibility that the average grain size of 10 μm to 40 μm as described above cannot be realized. Furthermore, in the case where the cooling rate in a sheet temperature range of 750° C. to 600° C. is less than 25° C./s, precipitation of carbides such as TiC occurs in the cooling process, and the solid solution C is decreased, so that strain aging due to solid solution C is not sufficiently obtained, and the upper yield point is less likely to occur, resulting in a reduction in the yield ratio. On the other hand, the upper limit of the cooling rate in a sheet temperature range of 750° C. to 600° C. is not particularly limited, but in practice, the upper limit is about 100° C./s. The cooling rate in a sheet temperature range of 750° C. to 600° C. is preferably 30° C./s or more and 60° C./s or less.

In addition, by performing slow cooling (including a case where the instantaneous cooling rate is 20° C./s or less) with a cooling rate of 20° C./s or less at least in a partial temperature range in a sheet temperature range of 400° C. to 100° C., strain aging due to solid solution C proceeds and the upper yield point is more likely to occur. It is more preferable that the steel sheet is retained in a temperature range of 400° C. to 100° C. for 16 seconds or more by performing slow cooling at least in the partial temperature range.

In the final annealing, the heating rate in a sheet temperature range of 750° C. to 900° C. is, for example, preferably set to 20° C./s to 1000° C./s. By setting the heating rate to 20° C./s or more, the magnetic properties of the non-oriented electrical steel sheet can be further improved. On the other hand, even if the heating rate is increased to more than 1000° C./s, the effect of improving the magnetic properties is saturated. The heating rate in a sheet temperature range of 750° C. to 900° C. in the final annealing is more preferably 50° C./s to 200° C./s.

The non-oriented electrical steel sheet 10 according to the present embodiment can be manufactured through the above-described steps.

<Step of Forming Insulating Coating>

After the above-mentioned final annealing, a step of forming the insulating coating is performed as necessary (step S111). Here, the step of forming the insulating coating is not particularly limited, and application and drying of a treatment solution may be performed by a known method using a known insulating coating treatment solution as described above.

The surface of the base metal on which the insulating coating is to be formed may be subjected to any pretreatment such as a degreasing treatment with an alkali or the like, or a pickling treatment with hydrochloric acid, sulfuric acid, phosphoric acid, or the like before applying the treatment solution, or the surface may be left as it is after the final annealing without being subjected to these pretreatments.

Hereinabove, the method of manufacturing the non-oriented electrical steel sheet according to the present embodiment has been described in detail with reference to FIG. 5.

(Method of Manufacturing Motor Core)

Subsequently, a method of manufacturing a motor core (rotor/stator) using the non-oriented electrical steel sheet according to the present embodiment as described above will be briefly described with reference to FIG. 2 again.

In the method of manufacturing a motor core obtained from the non-oriented electrical steel sheet according to the present embodiment, first, the non-oriented electrical steel sheet 10 according to the present embodiment is punched into a core shape (rotor shape/stator shape) (step 1), each of the obtained members is laminated (step 2), and a desired motor core shape (that is, a desired rotor shape and a desired stator shape) is formed. Since the non-oriented electrical steel sheet punched into the core shape is laminated, it is important that the non-oriented electrical steel sheet 10 used for manufacturing the motor core has the insulating coating 13 formed on the surface of the base metal 11.

Thereafter, annealing (core annealing) is performed on the non-oriented electrical steel sheet laminated in the desired stator shape (step 3). The core annealing is preferably performed in an atmosphere containing 70 vol % or more of nitrogen. Moreover, the annealing temperature of the core annealing is preferably 750° C. or more and 900° C. or less. By performing the core annealing under the above-described annealing conditions, grain growth proceeds from a recrystallized structure present in the base metal 11 of the non-oriented electrical steel sheet 10. As a result, a stator that exhibits desired magnetic properties is obtained.

In a case where the proportion of nitrogen in the atmosphere is less than 70 vol %, the cost of core annealing is increased, which is not preferable. The proportion of nitrogen in the atmosphere is more preferably 80 vol % or more, even more preferably 90 vol % to 100 vol %, and particularly preferably 97 vol % to 100 vol %. The atmosphere gas other than nitrogen is not particularly limited, but generally, a reducing mixed gas composed of hydrogen, carbon dioxide, carbon monoxide, water vapor, methane, and the like can be used. In order to obtain these gases, a method of burning propane gas or natural gas is generally adopted.

In a case where the annealing temperature of the core annealing is less than 750° C., sufficient grain growth cannot be realized, which is not preferable. On the other hand, in a case where the annealing temperature of the core annealing exceeds 900° C., grain growth of the recrystallized structure proceeds too much and the eddy-current loss is increased while the hysteresis loss is decreased, resulting in an increase in the total iron loss, which is not preferable. The annealing temperature of the core annealing is preferably 775° C. or more and 850° C. or less.

The soaking time for which the core annealing is performed may be appropriately set according to the above-mentioned annealing temperature, but can be set to, for example, 10 minutes to 180 minutes. In a case where the soaking time is less than 10 minutes, grain growth may not be sufficiently realized. On the other hand, in a case where the soaking time exceeds 180 minutes, the annealing time is too long, and there is a high possibility of a reduction in productivity. The soaking time is more preferably 30 minutes to 150 minutes.

The heating rate in a temperature range of 500° C. to 750° C. in the core annealing is preferably set to 50° C./Hr to 300° C./Hr. By setting the heating rate to 50° C./Hr to 300° C./Hr, various characteristics of the stator can be further improved, and even if the heating rate is increased to higher than 300° C./Hr, the effect of improving various characteristics is saturated. The heating rate in a temperature range of 500° C. to 750° C. in the core annealing is more preferably 80° C./Hr to 150° C./Hr.

The cooling rate in a temperature range of 750° C. to 500° C. is preferably set to 50° C./Hr to 500° C./Hr. By setting the cooling rate to 50° C./Hr or more, various characteristics of the stator can be further improved. On the other hand, even if the cooling rate is set to exceed 500° C./Hr, uneven cooling occurs and causes the introduction of strain due to thermal stress, so that there is a possibility that deterioration in iron loss may occur. The cooling rate in a temperature range of 750° C. to 500° C. in the core annealing is more preferably 80° C./Hr to 200° C./Hr.

The motor core can be manufactured through the above-described steps.

Hereinabove, the method of manufacturing a motor core according to the present embodiment has been briefly described.

[Examples]

Hereinafter, the non-oriented electrical steel sheet according to the present invention will be described in detail with reference to examples and comparative examples. The examples described below are only examples of the non-oriented electrical steel sheet according to the present invention, and the non-oriented electrical steel sheet according to the present invention is not limited to the following examples.

After heating a slab having the chemical composition shown in Table 1 below to 1150° C., the slab was subjected to hot rolling to a final sheet thickness of 2.0 mm at a finishing temperature of 850° C., and was wound at 650° C., whereby a hot-rolled sheet was obtained.

The obtained hot-rolled sheet was subjected to annealing hot-rolled sheet in an atmosphere with a dew point of 10° C. for 1000° C.×50 seconds. The average cooling rate from 800° C. to 500° C. after the annealing hot-rolled sheet was 7.0° C./s for No. 6, and 35° C./s for the others. After the annealing hot-rolled sheet, the scale on the surface was removed by pickling.

The obtained pickled sheet (hot-rolled sheet after the pickling) was subjected to cold rolling, whereby a cold-rolled steel sheet with a thickness of 0.25 mm was obtained. Furthermore, annealing was performed thereon in a mixed atmosphere of 10% hydrogen and 90% nitrogen with a dew point of 0° C. by changing the final annealing conditions (annealing temperature and soaking time) so as to achieve the average grain size as shown in Tables 2A and 2B below. Specifically, in a case of performing control to increase the average grain size, the final annealing temperature was increased and/or the soaking time was increased. In a case of performing control to decrease the average grain size, the opposite was applied.

The heating rates to a temperature range of 750° C. to 900° C. during the final annealing were all 100° C./s. Moreover, the cooling rate in a temperature range of 750° C. to 600° C. after the final annealing was 10° C./s for only Nos. 7 and 13, and 35° C./s for the others.

The minimum value of the cooling rate from 400° C. to 100° C. during the final annealing was as shown in Tables 2A and 2B. In the invention examples, the minimum value of the cooling rate from 400° C. to 100° C. was 20° C./s or less, and the retention time between 400° C. to 100° C. was 16 seconds or more.

Thereafter, an insulating coating was applied thereto, whereby a non-oriented electrical steel sheet was obtained. The insulating coating was formed by applying an insulating coating containing aluminum phosphate and an acrylic-styrene copolymer resin emulsion having a particle size of 0.2 μm so as to achieve a predetermined adhesion amount, and baking the insulating coating in the air at 350° C.

A portion of the obtained non-oriented electrical steel sheet was subjected to annealing (simply referred to as "annealing" in this experimental example because the processing was not performed on the core, but corresponds to core annealing, hereinafter, referred to as "pseudo core annealing") for 800° C.×120 minutes in a nitrogen atmosphere with a dew point of −40° C. (the proportion of nitrogen in the atmosphere is 99.9 vol % or more).

The heating rate and the cooling rate from 500° C. or more and 700° C. or less in the pseudo core annealing were respectively 100° C./Hr and 100° C./Hr.

TABLE 1

(unit: mass %, remainder consists of Fe and impurities)

| Steel Kind | C | Si | Mn | Al | Ni | Cu | P | S | Ti | Nb | Zr |
|---|---|---|---|---|---|---|---|---|---|---|---|
| A | 0.0028 | 3.7 | 0.9 | 0.30 | 0.03 | 0.06 | 0.01 | 0.0008 | 0.0011 | tr. | tr. |
| B | 0.0035 | 3.6 | 0.6 | 0.20 | 0.06 | 0.03 | 0.03 | 0.0011 | 0.0008 | 0.0005 | 0.0004 |
| C | 0.0027 | 3.6 | 0.8 | 0.40 | 0.05 | 0.06 | 0.02 | 0.0016 | 0.0028 | 0.0025 | 0.0013 |
| D | 0.0011 | 3.5 | 0.9 | 0.30 | 0.04 | 0.05 | 0.01 | 0.0018 | 0.0019 | tr. | tr. |
| E | 0.0022 | 3.6 | 0.6 | 0.65 | 0.01 | 0.07 | 0.01 | 0.0009 | 0.0016 | 0.0006 | 0.0005 |
| F | 0.0016 | 3.8 | 0.6 | 0.40 | 0.05 | 0.07 | 0.01 | 0.0016 | 0.0014 | 0.0047 | 0.0006 |
| G | 0.0018 | 4.1 | 0.5 | 0.001 | 0.03 | 0.05 | 0.01 | 0.0028 | 0.0015 | 0.0004 | tr. |
| H | 0.0023 | 3.6 | 1.6 | 0.30 | 0.05 | 0.05 | 0.01 | 0.0009 | 0.0007 | 0.0011 | 0.0004 |
| I | 0.0027 | 3.5 | 0.7 | 0.30 | 0.07 | 0.06 | 0.08 | 0.0013 | 0.0011 | 0.0016 | tr. |
| J | 0.0024 | 3.6 | 0.5 | 0.30 | 0.06 | 0.07 | 0.01 | 0.0011 | 0.0014 | tr. | tr. |
| K | 0.0016 | 4.2 | 0.5 | 0.20 | 0.03 | 0.04 | 0.01 | 0.0005 | 0.0007 | tr. | 0.0007 |

| Kind | V | Mo | Sn | Sb | N | O | C × (Ti + Nb + Zr + V) |
|---|---|---|---|---|---|---|---|
| A | tr. | 0.011 | 0.01 | tr. | 0.0014 | 0.0017 | 0.000003 |
| B | 0.0002 | 0.001 | 0.01 | 0.01 | 0.0022 | 0.0018 | 0.000007 |
| C | 0.0021 | 0.018 | 0.01 | tr. | 0.0018 | 0.0021 | 0.000023 |
| D | 0.0008 | 0.021 | 0.01 | tr. | 0.0027 | 0.0023 | 0.000003 |
| E | 0.0011 | 0.002 | tr. | 0.01 | 0.0021 | 0.0016 | 0.000008 |
| F | tr. | 0.013 | 0.01 | tr. | 0.0022 | 0.0022 | 0.000011 |
| G | 0.0005 | 0.012 | 0.03 | tr. | 0.0016 | 0.0024 | 0.000004 |
| H | 0.0006 | 0.0013 | 0.01 | tr. | 0.0028 | 0.0031 | 0.000006 |
| I | 0.0003 | 0.012 | 0.01 | tr. | 0.0023 | 0.0017 | 0.000008 |
| J | tr. | tr. | tr. | tr. | 0.0024 | 0.0022 | 0.000003 |
| K | tr. | 0.011 | 0.01 | tr. | 0.0013 | 0.0016 | 0.000002 |

For the non-oriented electrical steel sheet before and after the pseudo core annealing, the average grain size of the base metal was measured by observing a structure of a Z cross section of a thickness middle portion according to the cutting method of JIS G 0551 "Steels-Micrographic determination of the apparent grain size". In addition, for the non-oriented electrical steel sheet before and after the pseudo core annealing, Epstein test pieces were taken in the rolling direction and width direction, and the magnetic properties (iron loss W10/800 after the final annealing and before the pseudo core annealing and iron loss W10/400 after pseudo core annealing) were evaluated by the Epstein test according to JIS C 2550.

Furthermore, tensile test pieces were taken in the rolling direction according to JIS Z 2241 from the non-oriented electrical steel sheet after the final annealing and before the pseudo core annealing, and by conducting a tensile test, the yield point, tensile strength (TS), and yield ratio were measured. The various characteristics measured as described above are summarized in Tables 2A and 2B below.

TABLE 2A

| | | Finish annealing | | After final annealing | | | | After pseudo core annealing | | |
|---|---|---|---|---|---|---|---|---|---|---|
| No. | Steel kind | Minimum value of cooling rate in 400° C. to 100° C. (° C./s) | Average grain size (μm) | W10/800 (W/Kg) | Upper yield point − lower yield point (MPa) | TS (MPa) | Yield ratio | Average grain size (μm) | W10/400 (W/Kg) | Note |
| 1 | A | 14 | 9 | 54 | 16 | 682 | 0.87 | 75 | 10.3 | Comparative Example |
| 2 | | 18 | 18 | 40 | 14 | 641 | 0.85 | 83 | 10.0 | Invention Example |
| 3 | | 41 | 19 | 39 | 4 | 638 | 0.81 | 85 | 10.0 | Comparative Example |
| 4 | | 11 | 29 | 35 | 14 | 620 | 0.84 | 88 | 9.9 | Invention Example |
| 5 | | 25 | 31 | 35 | 3 | 618 | 0.80 | 84 | 10.0 | Comparative Example |
| 6 | | 13 | 33 | 35 | 4 | 615 | 0.81 | 85 | 10.0 | Comparative Example |
| 7 | | 11 | 34 | 35 | 3 | 614 | 0.80 | 84 | 10.0 | Comparative Example |
| 8 | | 9 | 42 | 34 | 4 | 607 | 0.81 | 76 | 10.2 | Comparative Example |
| 9 | | 16 | 70 | 32 | 0 | 592 | 0.79 | 72 | 10.6 | Comparative Example |
| 10 | | 13 | 94 | 32 | 0 | 586 | 0.78 | 97 | 10.4 | Comparative Example |

TABLE 2A-continued

| | | Finish annealing | After final annealing | | | | | After pseudo core annealing | | |
|---|---|---|---|---|---|---|---|---|---|---|
| No. | Steel kind | Minimum value of cooling rate in 400° C. to 100° C. (° C./s) | Average grain size (μm) | W10/800 (W/Kg) | Upper yield point – lower yield point (MPa) | TS (MPa) | Yield ratio | Average grain size (μm) | W10/400 (W/Kg) | Note |
| 11 | B | 17 | 16 | 44 | 15 | 631 | 0.86 | 73 | 10.7 | Invention Example |
| 12 | | 8 | 24 | 37 | 16 | 612 | 0.86 | 84 | 10.4 | Invention Example |
| 13 | | 12 | 30 | 37 | 4 | 603 | 0.81 | 80 | 10.2 | Comparative Example |
| 14 | | 36 | 33 | 36 | 4 | 599 | 0.81 | 76 | 10.6 | Comparative Example |
| 15 | | 18 | 38 | 35 | 7 | 594 | 0.83 | 62 | 10.8 | Invention Example |
| 16 | | 9 | 57 | 33 | 3 | 582 | 0.79 | 59 | 11.1 | Comparative Example |
| 17 | | 13 | 83 | 32 | 0 | 572 | 0.78 | 88 | 10.7 | Comparative Example |
| 18 | C | 12 | 21 | 43 | 19 | 628 | 0.88 | 54 | 12.2 | Invention Example |
| 19 | D | 13 | 16 | 42 | 4 | 625 | 0.81 | 86 | 10.0 | Comparative Example |
| 20 | | 15 | 23 | 36 | 3 | 608 | 0.80 | 92 | 9.9 | Comparative Example |
| 21 | | 16 | 46 | 33 | 1 | 582 | 0.79 | 97 | 9.9 | Comparative Example |
| 22 | | 13 | 66 | 32 | 0 | 572 | 0.77 | 73 | 10.2 | Comparative Example |
| 23 | | 16 | 87 | 32 | 0 | 565 | 0.77 | 92 | 10.1 | Comparative Example |
| 24 | E | 16 | 16 | 43 | 14 | 647 | 0.85 | 64 | 11.5 | Invention Example |
| 25 | | 12 | 24 | 36 | 14 | 628 | 0.84 | 68 | 11.3 | Invention Example |
| 26 | | 9 | 42 | 34 | 4 | 607 | 0.80 | 66 | 11.5 | Comparative Example |
| 27 | | 9 | 84 | 32 | 0 | 588 | 0.78 | 86 | 12.2 | Comparative Example |

TABLE 2B

| | | Finish annealing | After final annealing | | | | | After pseudo core annealing | | |
|---|---|---|---|---|---|---|---|---|---|---|
| No. | Steel kind | Minimum value of cooling rate in 400° C. to 100° C. (° C./s) | Average grain size (μm) | W10/800 (W/Kg) | Upper yield point – lower yield point (MPa) | TS (MPa) | Yield ratio | Average grain size (μm) | W10/400 (W/Kg) | Note |
| 28 | F | 11 | 17 | 44 | 14 | 653 | 0.85 | 45 | 12.4 | Invention Example |
| 29 | | 19 | 49 | 35 | 0 | 611 | 0.79 | 57 | 12.1 | Comparative Example |
| 30 | | 16 | 77 | 34 | 0 | 599 | 0.79 | 78 | 11.5 | Comparative Example |
| 31 | G | 10 | 16 | 42 | 16 | 668 | 0.86 | 75 | 10.2 | Invention Example |
| 32 | | 12 | 26 | 35 | 15 | 645 | 0.85 | 82 | 10.0 | Invention Example |
| 33 | | 34 | 32 | 34 | 3 | 637 | 0.81 | 80 | 10.2 | Comparative Example |
| 34 | | 8 | 36 | 34 | 9 | 633 | 0.82 | 76 | 10.4 | Invention Example |
| 35 | | 19 | 72 | 31 | 0 | 612 | 0.79 | 75 | 10.6 | Comparative Example |
| 36 | H | 12 | 13 | 45 | 17 | 662 | 0.85 | 88 | 9.7 | Invention Example |
| 37 | | 13 | 29 | 35 | 16 | 624 | 0.84 | 93 | 9.6 | Invention Example |
| 38 | | 9 | 60 | 31 | 0 | 600 | 0.78 | 72 | 10.1 | Comparative Example |

TABLE 2B-continued

| | | Finish annealing | After final annealing | | | | | After pseudo core annealing | | |
|---|---|---|---|---|---|---|---|---|---|---|
| No. | Steel kind | Minimum value of cooling rate in 400° C. to 100° C. (° C./s) | Average grain size (μm) | W10/800 (W/Kg) | Upper yield point – lower yield point (MPa) | TS (MPa) | Yield ratio | Average grain size (μm) | W10/400 (W/Kg) | Note |
| 39 | I | 13 | 14 | 48 | 16 | 648 | 0.84 | 81 | 10.5 | Invention Example |
| 40 | | 14 | 22 | 38 | 15 | 626 | 0.85 | 95 | 10.3 | Invention Example |
| 41 | | 13 | 38 | 35 | 6 | 605 | 0.82 | 76 | 10.7 | Invention Example |
| 42 | | 53 | 38 | 35 | 2 | 606 | 0.81 | 78 | 10.7 | Comparative Example |
| 43 | | 8 | 67 | 33 | 0 | 588 | 0.80 | 69 | 10.4 | Comparative Example |
| 44 | | 17 | 94 | 33 | 0 | 580 | 0.79 | 95 | 10.2 | Comparative Example |
| 45 | J | 14 | 11 | 49 | 15 | 648 | 0.85 | 83 | 10.0 | Invention Example |
| 46 | | 11 | 17 | 42 | 15 | 624 | 0.85 | 88 | 9.9 | Invention Example |
| 47 | | 11 | 39 | 34 | 6 | 589 | 0.84 | 94 | 9.8 | Invention Example |
| 48 | | 10 | 56 | 33 | 1 | 578 | 0.80 | 76 | 10.4 | Comparative Example |
| 49 | | 15 | 76 | 32 | 0 | 570 | 0.79 | 81 | 10.2 | Comparative Example |
| 50 | K | 16 | 18 | 40 | 16 | 683 | 0.85 | 76 | 9.8 | Invention Example |
| 51 | | 15 | 31 | 34 | 12 | 659 | 0.83 | 93 | 9.7 | Invention Example |
| 52 | | 42 | 37 | 33 | 1 | 653 | 0.80 | 80 | 9.9 | Comparative Example |
| 53 | | 16 | 59 | 32 | 3 | 639 | 0.80 | 71 | 10.1 | Comparative Example |
| 54 | | 10 | 73 | 31 | 0 | 633 | 0.79 | 74 | 10.7 | Comparative Example |

As is apparent from Tables 2A and 2B above, in Invention Examples Nos. 2, 4, 11, 12, 15, 18, 24, 25, 28, 31, 32, 34, 36, 37, 39 to 41, 45 to 47, 50, and 51, since the composition and the final annealing conditions were appropriately controlled, a yield ratio as high as 0.82 or more was obtained. In addition, each of an upper yield point and a lower yield point occurs, and the difference between the upper yield point and the lower yield point became 5 MPa or more.

However, in No. 18, since the value of "C×(Ti+Nb+Zr+V)" of steel kind C used exceeded 0.000010, although various characteristics before the pseudo core annealing were excellent, the average grain size after the pseudo core annealing was small, and the iron loss W10/400, which is a preferable properties due to the formation of carbides, exceeded 11 W/kg.

In addition, in Nos. 24 and 25, since the Al content exceeded 0.50%, Ti was not fixed as a nitride, and as a result, carbides were increased, so that the iron loss W10/400 after the pseudo core annealing exceeded 11 W/kg.

In No. 28, since the Nb content exceeded 0.0030 mass %, the iron loss W10/400 exceeded 11 W/kg due to the formation of carbides.

In the other invention examples, good results were obtained also in the magnetic properties after the pseudo core annealing.

On the other hand, in No. 1, since the average grain size after the final annealing was less than 10 μm, the iron loss W10/800 after the final annealing exceeded 50 W/kg.

In Nos. 8 to 10, 16, 17, 26, 27, 29, 30, 35, 38, 43, 44, 48, 49, 53, and 54, since the average grain size after the final annealing was less than 40 μm due to the influence of the final annealing temperature and the like, the upper yield point did not clearly occur and the yield ratio was decreased.

In Nos. 3, 5, 14, 42, and 52, the yield ratio was less than 0.82. In these steels, the grain size after the final annealing was 40 μm or less, but the upper yield point—the lower yield point was small. It is considered that rapid cooling at 20° C./s or more was performed throughout the cooling process from 400° C. to 100° C. of the final annealing and thus the aging effect by carbon was not exhibited sufficiently.

In No. 6, the yield ratio was less than 0.82. It is considered that in this steel, since the average cooling rate from 800° C. to 500° C. after the annealing hot-rolled sheet was less than those of the other steel kinds, solid solution carbon was precipitated as carbides during this time, and solid solution carbon contributing to strain aging had disappeared after recrystallization after the final annealing.

In Nos. 7 and 13, the yield ratio was less than 0.82. It is considered that in these steels, the cooling rate from 750° C. to 600° C. in the final annealing was less than those in the others, and carbides start to precipitate at high temperatures and cause overaging, resulting in a reduction in the upper yield point.

In Nos. 19 to 23, since the C content of steel kind D used was small, the upper yield point was not clearly generated, and the yield ratio was low.

While the preferred embodiments of the present invention have been described in detail with reference to the accompanying drawings, the present invention is not limited to these examples. It is obvious that those skilled in the art to which the present invention belongs can conceive of various changes or modifications within the scope of the technical spirit described in the claims, and it is understood that these naturally fall within the technical scope of the present invention.

[Industrial Applicability]

According to the present invention, it is possible to obtain a non-oriented electrical steel sheet in which the manufacturing cost is suppressed and the mechanical properties and the magnetic properties after core annealing are superior. Therefore, high industrial applicability is achieved.

BRIEF DESCRIPTION OF THE REFERENCE SYMBOLS

10: non-oriented electrical steel sheet
11: base metal
13: insulating coating

The invention claimed is:

1. A non-oriented electrical steel sheet comprising, as a chemical composition, by mass %:
C: 0.0015% to 0.0040%;
Si: 3.5% to 4.5%;
Al: 0.65% or less;
Mn: 0.2% to 2.0%;
Sn: 0% to 0.20%;
Sb: 0% to 0.20%;
P: 0.005% to 0.150%;
S: 0.0001% to 0.0030%;
Ti: 0.0030% or less;
Nb: 0.0050% or less;
Zr: 0.0030% or less;
Mo: 0.030% or less;
V: 0.0030% or less;
N: 0.0010% to 0.0030%;
O: 0.0010% to 0.0500%;
Cu: less than 0.10%;
Ni: less than 0.50%; and
a remainder including Fe and impurities,
wherein a product sheet thickness is 0.10 mm to 0.30 mm,
an average grain size is 10 μm to 40 μm,
an iron loss W10/800 is 50 W/Kg or less,
a tensile strength is 580 MPa to 700 MPa,
a yield ratio is 0.82 or more,
the non-oriented electrical steel sheet has an upper yield point and a lower yield point, and
the upper yield point is higher than the lower yield point by 5 MPa or more.

2. The non-oriented electrical steel sheet according to claim 1,
wherein amounts of C, Ti, Nb, Zr, and V satisfy conditions expressed by Formula (1), $$[C]\times([T]+[Nb]+[Zr]+[V])<0.000010 \quad (1)$$

where a notation [X] in the Formula (1) represents an amount of an element X (unit: mass %).

3. The non-oriented electrical steel sheet according to claim 1,
wherein the average grain size is 60 μm to 150 μm and the iron loss W10/400 is 11 W/Kg or less, when annealing is performed under annealing conditions within a range in which an annealing temperature is 750° C. or more and 900° C. or less and a soaking time is 10 minutes to 180 minutes.

4. The non-oriented electrical steel sheet according to claim comprising, as the chemical composition, by mass %:
any one or both of
Sn: 0.01% to 0.20%, and
Sb: 0.01% to 0.20%.

5. The non-oriented electrical steel sheet according to claim 1, further comprising:
an insulating coating on a surface of the non-oriented electrical steel sheet.

6. The non-oriented. electrical steel sheet according to claim 1 comprising, as the chemical composition, by mass %:
Al: 0.10% to 0.65%.

* * * * *